US005106000A

United States Patent [19]

Small et al.

[11] Patent Number: 5,106,000

[45] Date of Patent: Apr. 21, 1992

[54] NECKTIE HANDLING APPARATUS

[75] Inventors: Mason S. Small; Michael N. Bennison, both of Leeds, England

[73] Assignee: AMF Sewn Products, Inc., Richmond, Va.

[21] Appl. No.: 688,106

[22] Filed: Apr. 19, 1991

[30] Foreign Application Priority Data

May 10, 1990 [GB] United Kingdom ..... 9010500

[51] Int. Cl.[5] ..... A41H 43/00

[52] U.S. Cl. ..... 223/40; 223/39; 223/42

[58] Field of Search ..... 223/40, 39, 41, 42; 66/147, 149 S, 150

[56] References Cited

U.S. PATENT DOCUMENTS

| | | | |
|---|---|---|---|
| 884,910 | 4/1908 | Dryden | 223/42 |
| 884,911 | 4/1908 | Dryden | 223/42 |
| 1,750,005 | 3/1930 | Hemmerich | 223/39 |
| 1,811,049 | 6/1931 | Hemmerich | 223/39 |
| 2,340,420 | 2/1944 | Newman | 223/40 |
| 3,467,289 | 9/1969 | Preston | 223/40 |
| 4,620,649 | 11/1986 | Graham | 223/42 X |
| 4,749,111 | 6/1988 | Hardwick | 223/42 |

FOREIGN PATENT DOCUMENTS

| | | | |
|---|---|---|---|
| 2058166 | 4/1981 | United Kingdom | 223/39 |

*Primary Examiner*—Werner H. Schroeder
*Assistant Examiner*—Bibhu Mohanty
*Attorney, Agent, or Firm*—Staas & Halsey

[57] ABSTRACT

Apparatus for use in turning inside out a stitched, hollow necktie assembly includes a guide comprising a hollow tube (2) of which part (4) of the wall is cut away over a shaped length extending from an intermediate part of the tube to a first end region thereof. A turning loop (7) is angled away from the first end region of the tube, the outer surface of the turning loop lying substantially within the projection of the outer surface of the tube along the axis thereof. The turning loop has a turning surface (27) facing generally away from the tube and an opposite surface (28) facing generally towards the tube. The perimeter of the minimum envelope at any part of the shaped length of the tube and at any part of the turning loop is less than the cross-sectional external perimeter of the tube. Drive mechanisms (13,14) are provided for driving a tie engagement mechanism (21) between an advanced position adjacent to the turning loop and a retracted position. During movement to the retracted position the engagement means pulls the tie assembly through the turning loop, around which the assembly is turned inside out, and complete through the tube.

24 Claims, 1 Drawing Sheet

NECKTIE HANDLING APPARATUS

This invention relates to necktie handling apparatus, and in particular to apparatus for use in turning inside out a stitched, hollow necktie assembly.

The final stitching operation in mechanized tie production is to secure interfacing in position, and to form a seam along the face fabric of the necktie, which seam will in use extend along the centre of the rear of the tie. At the end of this operation a stitched, hollow necktie assembly is formed and in order to achieve the finished tie this assembly must be turned inside out.

This turning operation has commonly been performed manually. However, in one automated system the necktie assembly is threaded onto a tube, and is then turned inside out by pushing the narrow end of the tie through the tube so that the assembly turns over one of the exposed ends of the tube. Neckties usually comprise a broad end and a narrow end. In order to allow threading of substantially the full length of the necktie assembly the outer diameter of the tube must be such that the narrow end of the assembly can be threaded thereon. However, this restricts the internal diameter of the tube, with the consequence that when the assembly is being pulled through the tube in order to turn it inside out the bulk of the broad end of the tie is a very close fit within the tube. This causes unwanted stressing of the necktie assembly, and leads to the assembly being stretched or otherwise damaged.

The object of the invention is to reduce or obviate this problem.

According to the invention a guide for use in turning inside out a stitched, hollow necktie assembly comprises a hollow tube of which part of the wall is cut away over a shaped length extending from an intermediate part of the tube to a first end region thereof, and a turning loop angled away from the first end region of the tube, the turning loop having a turning surface facing generally away from the tube and an opposite surface facing generally towards the tube, the perimeter of the minimum envelope at any part of the shaped length of the tube and at any part of the turning loop being less than the cross-sectional external perimeter of the tube.

By cutting away part of the wall of the tube the minimum envelope over that part of the tube can be reduced without reducing the effective internal dimensions of the tube. Similary, the internal dimensions of the turning loop can be maintained equal to that of the tube, the reduction of the minimum envelope of the turning loop being achieved by suitable selection of the angle and shaping of that loop. Thus, a guide in accordance with the invention allows a reduction of the envelope over which the narrower end of the assembly is to be fitted, without causing a corresponding reduction of the internal dimensions of the tube. A hollow necktie assembly can thus be turned with little, if any, damage being caused to the assembly. The minimum envelope of the turning loop desirably nowhere exceeds 0.75 the external perimeter of the tube.

Preferably, the outer surface of the turning loop lies substantially within the projection of the outer surface of the tube along the axis thereof.

Preferably, the tube wall is cut away by a cut of which at least part lies substantially in a plane making an acute angle or a right angle with a plane perpendicular to the axis of the tube. The whole length of the cut need not be in such a plane, and the cut may be curved and/or stepped if required. When the cut does lie in a plane as aforesaid then the angle which that plane makes with the plane perpendicular to the axis of the tube may. conveniently lie between 85° and 90°.

The tube wall is preferably cut away so that the limits of the remaining part of the tube wall in the first end region of the tube subtend an angle no greater than 180° at the axis of the tube. Higher angles are, however possible. Obviously, smaller subtended angles will lead to smaller minimum envelopes in the first end region of the tube, however a minimum subtended angle of 90° is preferred in order to maintain reasonable rigidity in the first end region of the tube and to leave a reasonable guide surface on which the necktie assembly runs as it is pulled through the tube.

Perferbly the turning surface and the opposite surface of the turning loop are parallel, and each lies substantially in a plane making an acute angle with a plane perpendicular to the axis of the tube. Plane, parallel surfaces are perferred, although it will be understood that the surfaces need not be parallel, and also that they may be curved or stepped if so required. When the surfaces are plane, then the acute angle made with a plane perpendicular to the axis of the tube is preferably no less than 30°, and is desirably between 30° and 45°.

Theoretically, both the tube and the turning loop may be of any suitable cross-section, although a circular cross-section is preferred for each of these. The turning loop is then preferably coaxial with the tube, and has internal and external diameters similar to those of the tube. The loop is then desirably integral with the tube so that the whole of the guide is formed from a single length of hollow tube suitably cut to form both the shaped length of the tube and the turning loop. The tube is preferably straight throughout its length, although it is possible to use curved or partly-curved tubes, particularly tubes that are partly curved from the intermediate part of the tube towards a second end region of the tube.

The invention also extends to apparatus for turning inside out a stitched hollow necktie assembly, the apparatus comprising a guide as aforesaid, engagement means locatable adjacent the turning loop for engaging an end of the assembly after threading over the tube and turning loop, and drive means for driving the engagement means through the turning loop and through the tube.

In operation, the engagement means is located adjacent the turning loop and the necktie assembly is then threaded over the tube and turning loop, the broader end of the assembly leading. The free section of the narrow end of the assembly is engaged with the engagement means and the drive means is then operated to drive the engagement means through the turning loop and through the tube. This action pulls the assembly through the turning loop and the tube, the narrow end leading, the fabric of the assembly turning on the turning surface of the turning loop as the engagement means is moved.

The drive means is preferably operative to drive the engagement means out of the second end region of the tube and a considerable distance beyond the second end region, so as to pull the turned assembly completely through the tube. The turning is thus effected in a single movement of one engagement means. Alternatively, the engagement means may be effective to push the narrow end of the assembly partly or wholly through the tube to a location where it is picked up by further engagement means, movement of which then completes the turning operation.

The path of travel of the engagement means is desirably rectilinear, although, particularly beyond the intermediate part of the tube, it may be at least partially curved.

Preferably the drive means comprises a drive carriage movable between an advanced position lying adjacent to a mount for the tube and a retracted position, a rod extends from the carriage through the tube when the carriage is in the advanced position and the engagement means is carried at a free end of the rod.

Desirably the rod extends through a sleeve having a first end secured to carriage and a second end lying adjacent to the engaging means, and second drive means are provided for moving the rod longitudinally with respect to the sleeve to move the engaging means into gripping relationship with the second end of the sleeve.

In order that the invention may be better understood apparatus in accordance therewith will now be described in more detail, by way of example only, with reference to the accompanying drawings in which:

FIGURES

DESCRIPTION OF THE INVENTION

Figures 1, 2, 3, 4, 5, 6, 7:
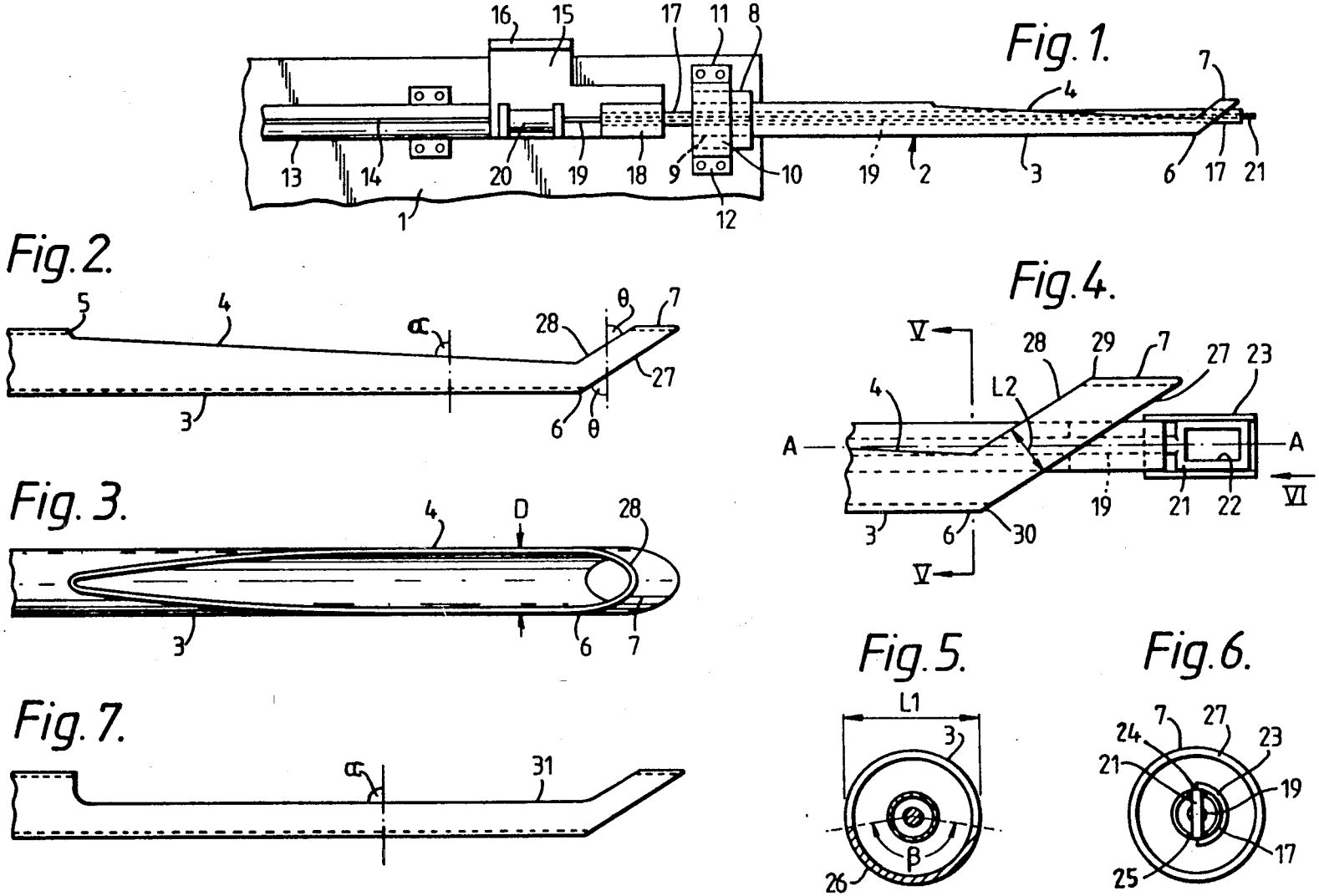
FIG. 1 is a schematic side elevation of tie-turning apparatus according to the invention.
FIG. 2 is an enlarged side elevation of part of a guide used in the apparatus of FIG. 1.
FIG. 3 is a plan view corresponding to FIG. 2.
FIG. 4 is a further inlarged side elevation of one end of the apparatus shown in FIG. 1.
FIG. 5 is a section on the line V—V of FIG. 4.
FIG. 6 is an end elevation in the direction of arrow VI of FIG. 4.
FIG. 7 is a side elevation similar to FIG. 2 of part of a second embodiment of guide.

Referring to FIG. 1 this shows a tie-turning apparatus mounted on a support 1. The apparatus may be free standing, in which case two or more sets of apparatus may be mounted on a single support, or it may be integrated into automatic tie handling apparatus for example as described in GB-A-2216550.

The apparatus comprises a guide 2 comprising a hollow tube 3 of which part of the wall is cut away over a shaped length 4 extending from an intermediate part 5 of the tube to a first end region 6 thereof. A turning loop 7 is angled away from the first end region 6 of the tube. The tube carries a collar 8 adjacent to a second end region 9 thereof, and the second end region is a push fit into a cirular bore in a mount 10 secured to the support 1 by brackets 11, 12. The push fit enables the tube to be removed rapidly from the mount if mecessary, for example in an emergency where an operator's finger may have become trapped.

The support 1 carries a ram 13 of the floating piston type, a drive member projecting outwardly through a seal 14 on the outer surface of the ram cylinder and capable of opening an closing behind the drive member. A suitable ram is that manufactured and sold by Origa Limited of the United Kingdom under the name "rodless cylinder".

The drive member of the ram 13 is secured to, and supports a drive carriage 15 movable between the advanced positionn shown in FIG. 1 wherein the carriage lies adjacent to the mount 10 and a retracted position lying to the left of the part of the apparatus shown in FIG. 1. The ram 13 is rectilinear, and the path of travel of the carriage 15 is thus also rectilinear. The carriage has a counter balance 16 projecting into the plane of the paper and lying above the support 1.

A hollow sleeve 17 fits into and is secured within a bore of a mount 18 fixed to carriage 15. When the carriage is in the advanced position the sleeve extends through the tube 3 and turning loop 7 project from that loop as shown in FIGS. 1 and 4. A rod 19 extends through the sleeve and has one end secured to the piston of a pneumatic ram 20, the cylinder of which is secured to the carriage 15. The free end of the rod carries tie engagement means in the form of a loop 21 with an opening 22, a shield 23 lying behind the opening and being secured to the end of the sleeve 17. Retraction of the piston within the ram 20 moves the rod 19 to the left as seen in the Figures relative to the sleeve 17, so that the loop 21 retracts into opposed grooves 24, 25 formed in the end of sleeve 17.

The shape of the guide 2 will now be considered in more detail. As shown, the guide is fabricated from a single straight length of hollow tubing. The shaped length 4 of the guide is formed by cutting away part of the tube wall long a cut of which the major part lies in a plane making an acute angle $\alpha$ with a plane perpendicular to the axis of the tube. In the example shown $\alpha$ is 85°; it may have a different value. The tube wall is cut away so that the limits of the remaining part 26 of the tube wall in the first end region 6 subtend an angle $\alpha$ at the axis of the tube that is no greater than 180°, and desirably no less than 90°. In the example shown the angle $\alpha$ is about 160°.

The turning loop 7 is formed by further cutting of the tubing to define a turning surface 27 facing generally away from the tube 3 and an opposite surface 28 facing generally towards that tube. The faces are parallel, and each lies in a plane making an acute angle $\theta$ with a plane perpendicular to the axis of the tube. The angle $\theta$ is no less than 30° and is preferably between 30° and 45°. As already stated, it is necessary to the invention that the perimeter of the minimum envelope at any part of the shaped length 4 of the tube and at any part of the turning loop 7 is less that the cross-sectional external perimeter (in the example shown in the drawings the outside diameter) of the tube. This will always be the case for the shaped length 4 of tube, where the perimeter of the minimum envelope is the outer circumference of the remaining part of the tube wall plus the length L1 of the chord between the extremities of the remaining part of the tube wall. The length of chord L1 will always be less that the circumference of the cut away part of the tube wall.

For the condition to be satisfied so far as the turning loop is concerned it is necessary to consider the loop at its broadest part, i.e. the part lying in the region of the diametrical plane A—A. In this region the minimum envelope of the turning loop is equal to the outside diameter D of the tube (FIG. 3) measured both across the turning surface 27 and across the opposite surface 28, plus twice the perpendicular distance L2 measured between the planes of the turning surface 27 and of the opposite suface 28. Thus, for the minimum envelope of the turning loop to be less than the outer circumference of the tube $2(D+<2)< D$. The length L2 must therfore be less than 0.57D, i.e. less than 1.14 times the radius of the tube. In practice it is preferred that the perpendicular distance L2 be from 0.3 to 0.8 the radius of the tube.

The fact that the values of 0 and L2 are chosen to give this minimum envelope relationship means that the part 29 of the opposite surface of the turning loop lying furthest from the tube will be more remote from the tube 3 than the part 30 of the turning surface lying closest to the tube. It will be appreciated that this relationship between the parts 29 and 30 is another way of defining the shape and demensions of the turning loop in relation to the tube.

Operation of the apparatus will be apparent. With the parts in the starting position shown in FIG. 1, a stitched, hollow necktie assembly is threaded and bunched over the turning loop 28 and the tube 2, the broader end of the assembly being threaded on first and fitting comfortably even over the full diameter of the tube 2. The narrower end of the assembly is received over the turning loop and the shaped length 4 of the tube, and can again comfortably be accomodated thereon. When substantially the full length of the assembly is in position the free tip of the assembly is inserted in the opening 22 of loop 21, the shield 23 preventing too much fabric from passing through the opening. The ram 20 is operated to move the loop 21 to the left as shown in FIG. 4, so clamping the free tip of the assembly between the loop 22 and the sleeve 17. The ram 13 is then operated to drive the carriage 15 to the left, so moving sleeve 17 in a similar direction, the sleeve pulling the narrow end of the necktie assembly with it. The assembly is unfurled from the tube and turned over the turning edge 27 of the turning loop. Movement of the carriage continues until the whole length of the assembly has been taken from the tube, turned around the turning edge 27 and pulled through the tube to a position clear thereof. The ram 20 is extended, the tip of the assembly removed from the loop 22 and the turned necktie removed. The apparatus is then returned to the original position ready for a further cycle.

It will be appreciated that the apparatus can be modified from that illustrated. In particular the shaped length 4 of the tube wall may not lie in a single plane but may be suitably curved or stepped, or may have a tapering section extending from the intermediate part 5 and thereafter a further section lying in or parallel to a diametrical plane of the tube. A tube of the latter configuration is shown in FIG. 7 and indicated by the reference numeral 31. The angle $\alpha$ for this tube is 90°.

Similarly, the turning surface 27 and opposite surface 28 of the turning ring need not be planar, but may have other shapes as long as the required envelope is maintained. Clearly the shapes adopted for all these parts will be such that they will not adversely affect the fabric of the necktie assembly, which should be capable of running smoothly over the various surfaces. The turning ring need not be formed integrally with the tube, and could be a separate part secured to the end of the tube by adhesive or any other suitable means. The separate part may be of the same, or of different material, than the tube. The means for engaging the free tip of the assembly may take any one of a number of forms, and may, for example, include a cut-out section in the wall of sleeve 17 towards the free end thereof, that end being axially closed by a resilient stop, a rod extending through the sleeve and means for pushing the rod towards the stop to clamp the free tip therebetween. Retraction of the rod and release of the tip after turning may be controlled by a microswitch or other sensor operated by the carriage 15.

We claim:

1. A guide for use in turning inside out a stitched, hollow necktie assembly, comprising a hollow tube of which part of the wall is cut away over a shaped length extending from an intermediate part of the tube to a first end region thereof, and a turning loop angled away from the first end region of the tube, the turning loop having a turning surface facing generally away from the tube and an opposite surface facing generally towards the tube, the perimeter of the minimum envelope at any part of the shaped length of the tube and at any part of the turning loop being less than the cross-sectional external perimeter of the tube.

2. A guide as claimed in claim 1 in which the outer surface of the turning loop lies substantially within the projection of the outer surface of the tube along the axis thereof.

3. A guide as claimed in claim 1 in which the tube wall is cut away by a cut at least part of which lies substantially in a plane making an angle no greater than 90° with a plane perpendicular to the axis of the tube.

4. A guide as claimed in claim 1 in which the tube wall is cut away so that the limits of the remaining part of the tube wall at least in the first end region subtend an angle not greater than 180° at the axis of the tube.

5. A guide as claimed in claim 1 in which the turning surface and the opposite surface of the turning loop are parallel, and each lies substantially in a respective plane making an acute angle with a plane perpendicular to the axis of the tube.

6. A guide as claimed in claim 5 in which the angle is no less than 30°.

7. A guide as claimed in claim 1 in which the tube is of circular cross-section.

8. A guide as claimed in claim 1 in which the turning loop is of circular cross-section.

9. A guide as claimed in claim 8 in which the turning loop is coaxial with the tube and has internal and external diameters similiar to those of the tube.

10. A guide as claimed in claim 9 in which the turning loop is integral with the tube.

11. A guide as claimed in claim 6 in which the perpendicular distance between the planes of the turning surface and the opposite surface of the turning loop is no greater than the radius of the tube.

12. A guide as claimed in claim 11 in which said perpendicular distance is from 0.3 to 0.8 the radius of the tube.

13. A guide as claimed in claim 1 in which the tube is straight throughout its length.

14. An apparatus for turning inside out a stitched hollow necktie assembly, comprising a guide including a hollow tube of which part of the wall is cut away over a shaped length extending from an intermediate part of the tube to a first end region therof, and a turning loop angled away from the first end region of the tube, the turning loop having a turning surface facing generally away from the tube and an opposite surface facing generally towards the tube, the perimeter of the minimum envelope at any part of the shaped length of the tube and at any part of the turning loop being less than the cross-sectional external perimeter of the tube, tie engagement means locatable adjacent the turning loop for engaging an end of the assembly after threading the assembly over the tube and said turning loop, and drive means for driving the tie engagement means to pass through the turning loop and through the tube towards a second end region of the tube.

15. Apparatus as claimed in claim 14 in which the drive means is operative to drive the engagement means out of the second end region of the tube and a considerable distance beyond said second end region so as to pull the turned assembly completely through the tube.

16. Apparatus as claimed in claim 14 in which the path of travel of the engagement means is rectilinear.

17. Apparatus as claimed in claim 14 in which the drive means comprises a drive carriage movable between an advanced position lying adjacent to a mount for the tube and a retracted position, a rod extends from the carriage through the tube when the carriage is in the advanced position and the engagement means is carried at a free end of the rod.

18. Apparatus as claimed in claim 17 in which the tube is supported on the mount by a quick-release connection.

19. Apparatus as claimed in claim 17 in which the rod extends through a sleeve having a first end secured to the carriage and a second end lying adjacent to the engaging means, and second drive means are provided for moving the rod longitudinally with respect to the sleeve to move the engaging means into gripping relationship with the second end of the sleeve.

20. Apparatus as claimed in claim 19 in which the second drive means is a pneumatic ram mounted on the drive carriage.

21. Apparatus as claimed in claim 19 in which the tube wall is cut away by a cut at least part of which lies substantially in a plane making an angle no greater than 90° with a plane perpendicular to the axis of the tube, and so that the limits of the remaining part of the tube wall at least in the first end region subtend an angle not greater than 180° at the axis of the tube.

22. Apparatus as claimed in claim 19 in which the turning surface and the opposite surface of the turning loop aare parallel, and each lies substantially in a respective plane making an acute angle with a plane perpendicular to the axis of the tube.

23. Apparatus as claimed in claim 19 in which the turning loop is integral with the tube.

24. Apparatus as claimed in claim 19 in which the perpendicular distance between the planes of the turning surface and the opposite surface of the turning loop is from 0.3 to 0.8 the radius of the tube.

* * * * *